US006131358A

United States Patent [19]

Wise

[11] Patent Number: 6,131,358

[45] Date of Patent: Oct. 17, 2000

[54] JOIST HANGER AND INSTALLATION METHOD

[76] Inventor: Michael A. Wise, 7851 S. River Rd., Marine City, Mich. 48039

[21] Appl. No.: 08/920,914

[22] Filed: Aug. 29, 1997

[51] Int. Cl.[7] ..... E04B 1/38

[52] U.S. Cl. ..... 52/702; 52/289

[58] Field of Search ..... 52/92.1, 289, 702, 52/707, 715, 36.4, 73; 248/216.1, 231.91

[56] References Cited

U.S. PATENT DOCUMENTS

| | | | |
|---|---|---|---|
| 804,451 | 11/1905 | Carlson | 52/702 |
| 1,385,765 | 6/1921 | Wells . | |
| 1,394,550 | 10/1921 | Herbrick | 52/289 X |
| 1,692,351 | 11/1928 | Ropp . | |
| 2,871,542 | 2/1959 | Bergdal . | |
| 3,537,221 | 11/1970 | Helfman et al. | 52/702 |
| 3,837,135 | 9/1974 | Zachman . | |
| 4,387,543 | 6/1983 | Tschan et al. | 52/295 |
| 4,584,813 | 4/1986 | Hudson . | |
| 4,598,524 | 7/1986 | Cheng . | |
| 4,982,548 | 1/1991 | Abbey . | |
| 5,228,261 | 7/1993 | Watkins . | |
| 5,390,459 | 2/1995 | Mensen . | |
| 5,845,453 | 12/1998 | Goya | 52/702 |

FOREIGN PATENT DOCUMENTS

| | | | |
|---|---|---|---|
| 2228955 | 9/1990 | United Kingdom | 52/702 |

OTHER PUBLICATIONS

ABB Building System, Inc., "Insulated Concrete Wall Form, 03100," Jan. 1996, pp. 1–2.

ABB Building System, Inc., Installation Manual for BLUE-MAXX Wallsystems, Jan. 15, 1996, p. 60.

*Primary Examiner*—Richard Chilcot

*Attorney, Agent, or Firm*—Brooks & Kushman P.C.

[57] ABSTRACT

A joist hanger includes a thin, flat base whose back side defines a surface area sufficient to cover a rearwardly-tapered through-hole formed in an interior panel of a modular wall preform. The joist hanger includes at least one anchor member on the back side of the base. Each anchor member extends rearwardly from the base into the through-hole to a depth greater the nominal thickness of the first panel. Each anchor member defines an angled deflecting surface such that, with the joist hanger's base secured to the panel so as to cover the through-hole, and with the anchor members extending into and through the through-hole, wall material poured into the preform will be urged by the deflecting surfaces toward the back side of the joist hanger, into the through-hole and around the anchor members, whereby the presence of voids behind the joist hanger is greatly reduced.

32 Claims, 3 Drawing Sheets

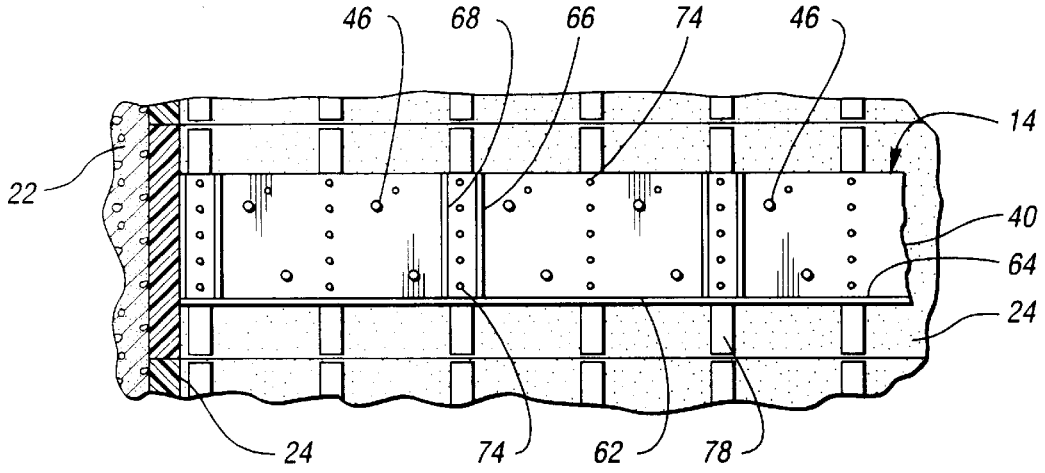
Fig. 5
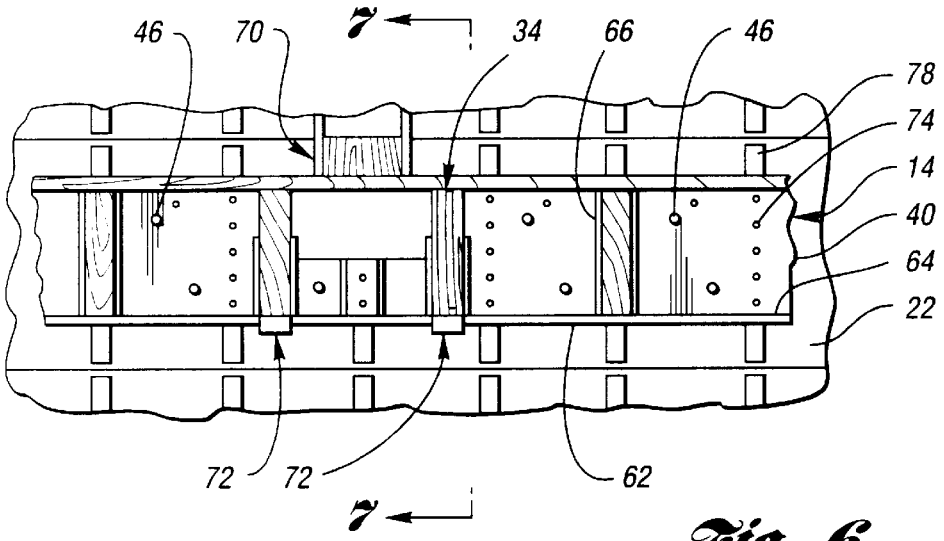
Fig. 6
Fig. 7
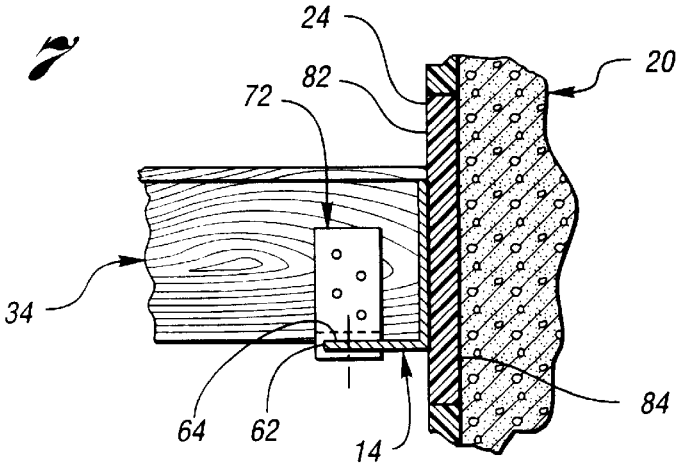

JOIST HANGER AND INSTALLATION METHOD

TECHNICAL FIELD

The invention relates to joist hangers which may be integrated within composite walls formed of concrete poured between the opposed high-density foam panels of stacked modular wall preforms, and an installation method for such joist hangers.

BACKGROUND ART

The prior art teaches a method of constructing poured concrete walls in which modular wall preforms, each comprising a pair of high-density foam panels which are maintained in a parallel-spaced relationship by a series of bridging "webs" extending between and through and molded into the panels, are interlockingly stacked together to define a concrete form for the poured concrete wall. With reinforcing steel bars optionally suspended within the assembled wall form, preferably through use of hooks or other retainers provided on each bridging web, the concrete is thereafter poured between the panels to complete the wall.

Unlike other known methods of constructing poured concrete walls in which the form's panels are removed from the poured concrete wall prior to the complete curing thereof, in the method employing these modular foam-panel preforms, the preforms become a permanent part of the resulting composite wall structure, with the interlocking foam panels providing a highly-effective layer of insulation on both sides of the finished wall. Further, where the webbing terminates on the outside of each panel to define integral furring strips, finishing materials may be conveniently applied directly to the interior and exterior of the wall.

While this method has proved highly successful in constructing poured concrete basement walls, with first-floor joists supported by the wall's top surface in a conventional manner, there remains a need to provide a simple yet effective apparatus and method by which joists may be supported by the wall at a height beneath its top surface.

More specifically, in a first known method of supporting joists at a height beneath the wall's top surface, after stacking several courses of modular preforms, and before pouring the concrete, the joists are laid out across the stacked preforms such that the end of each joist projects beyond the interior panel to a sufficient depth within the wall form. Special notched-panel preforms are thereafter assembled between and on top of the joists to define the portions of the wall therebetween, and the concrete is thereafter poured to a height above the top of each joist's inwardly-projecting end.

Unfortunately, this first method for supporting joists requires the concurrent and precisely-coordinated efforts of tradesmen skilled in both concrete and carpentry, with an attendant increase in labor costs. Additional bracing for the joists and modular preforms is often required. A failure to properly position the projecting joist end relative to the preform can substantially effect either the quality of the support provided by the wall or the integrity of the wall, or both. Building codes often prohibit direct contact between concrete and wood and, further, provide that joists imbedded within concrete be "fire cut" with a vertical chamfer such that the joist's upper edge does not catch the wall, thereby reducing the load-bearing capacity of such embedded joists. And, of course, the vertical repositioning of any given joist is virtually impossible. Perhaps most significantly, this first method often results in the creation of air pockets or "voids" in the poured concrete wall directly beneath each projecting joist end. Such voids can significantly contribute to premature failure of the juncture of wall and joist.

In accordance with a second known method for supporting joists at a height beneath the top surface of a poured concrete wall, U-shaped metal brackets are inserted through a series of spaced, complementary U-Shaped holes cut in a given course of foam preforms such that one end of the bracket extends well into the hollow space between the two foam panels. The other end of the bracket continues to project from the surface of the interior panel to provide a U-shaped hanger into which a given joist may be placed. The bracket includes nailing apertures to facilitate nailing the joist to the bracket.

While the second method is readily practiced by concrete tradesmen alone, the bight portion of the U-shaped bracket renders the second method particularly susceptible to void formation beneath each bracket. Moreover, since the holes in the interior panel are sized so as to tightly receive the bracket, the concrete does not flow into the holes. As a result, in the finished wall, each joist is undesirably supported by the bracket in an extended cantilevered fashion, with the end of the joist spaced from the poured concrete a distance equal to the thickness of the interior panel. Additional failure modes are thus created in a building constructed in accordance with this second method.

In accordance with a third known method for supporting joists at a height beneath the top surface of a poured concrete wall, rectangular, rearwardly-tapering holes are cut in a given course of the stacked foam preforms. A wood ledger, preferably of the same vertical dimension as the floor joists, is fastened with screws to the interior panel such that the ledger covers each hole. The ledger is thereafter drilled and L-shaped anchor bolts inserted therethrough so as to extend well into the hollow space between the two foam panels. After the concrete is poured, and with the anchor bolts tightened only after the concrete has completely cured, joists are thereafter nailed to the ledger using conventional metal joist hangers.

While its rearwardly-tapering holes facilitate the flow of poured concrete around each anchor bolt and, hence, reduce the occurrence of deleterious voids in the finished wall, the third method for supporting joists is highly labor-intensive and time-consuming, requiring the discrete, serial steps of: forming tapered holes; sizing and positioning the ledger; attaching the ledger to the interior panel; drilling holes in the ledger for the anchor bolts; inserting the anchor bolts, exercising care to ensure that each anchor bolts extends a sufficient depth into the form; pouring the concrete, preferably while mechanically vibrating the stacked preforms to facilitate flow of the concrete into the tapered holes and about the anchor bolts; waiting for the concrete to cure; tightening the anchor bolts, thereby drawing the ledger against the concrete projections defined by the tapered holes; nailing conventional joist hangers onto the ledger; and inserting and nailing the joists in the joist hangers.

DISCLOSURE OF INVENTION

It is an object of the invention to provide a joist hanger for a poured concrete wall, and an installation method therefor, which overcomes the aforesaid deficiencies of the prior art.

It is also an object of the invention to provide a joist hanger for a poured concrete wall, and an installation method therefor, featuring ease of use.

Another object of the invention is to provide a joist hanger for a poured concrete wall, and an installation method therefor, which reduces or eliminates the presence of deleterious voids in the finished wall.

Under the invention, a joist hanger for a composite wall formed of an insulating panel and a curable material, such as concrete or other suitable material, poured against the rear face of the panel, includes a thin base having a front side and a back side. The back side of the base defines a surface area sufficient to cover, at the panel's front face, a through-hole formed in the panel and extending between the front and rear faces thereof.

The joist hanger includes one or more anchor members on the base extending rearwardly from its back side. A deflecting surface on at least one anchor member is disposed at a first angle with respect to a reference plane generally parallel to the back side such that, when the material is poured against the panel's rear face, poured material is urged by the first surface toward the back side of the base. Preferably, the deflecting surface is disposed at an angle between about 5 degrees and about 30 degrees with respect to the reference plane.

In a preferred embodiment, each anchor member which extends rearwardly from the base to a depth exceeding the nominal thickness of the panel proximate to the through-hole, and the deflecting surface is conveniently defined by a flanged end portion of each anchor member. Also in the preferred embodiment, each anchor member is nonremovably secured to the base, thereby ensuring both that the anchor member extends to the proper depth and that the deflecting surface is properly oriented to vertical when the base is positioned against the panel's front face. The base may preferably include an aperture for receiving an end of the anchor member in order to increase the load-carrying capacity of the joist hanger.

The joist hanger further includes a first flange on the base extending from its front side. The first flange, which is preferably integrally formed with the base, defines a first joist-supporting surface which is generally perpendicular to the reference plane. In a preferred embodiment, the joist hanger further includes at least one additional flange extending from the front side of the base, with each additional flange defining an additional joist-supporting surface that is generally perpendicular to the first joist-supporting surface of the first flange. The additional flanges, which provide lateral support for one or more joists to be supported by the joist hanger, are preferably secured to both the front side of the base and the first joist-supporting surface of the first flange.

The joist hanger further includes a plurality of apertures formed in the periphery of the base along the two opposite edges thereof which, upon installation of the joist hanger, form the joist hanger's vertical edges. The apertures are adapted to receive fasteners with which to secure the base to the panel's front face prior to pouring the material against the panel's rear face. The joist hanger base also preferably includes a vent extending from the back side of the base to its front side. Preferably, the vent is positioned near an anchor member such that, when the base is positioned against and secured to the front face of the panel, the vent overlies a through-hole into which the anchor member extends while further being positioned in a vertical plane above each and every anchor members extending into that hole. Thus positioned, the vent facilitates monitoring the proper flow of poured material into the panel's through-hole.

Under the invention, a method for hanging a joist on a composite wall to be formed of an insulating panel and a curable material poured adjacent to a rear face of the panel, the method includes forming a through-hole in the panel extending from the rear face to a front face of the panel, wherein the through-hole has an upper portion and a lower portion; securing a joist hanger to the front face of the panel such the joist hanger's back side covers the through hole while an anchor member on the joist hanger extends rearwardly from the back side into the through-hole, and such that the anchor member defines a deflecting surface which forms a first angle with respect to a reference plane generally parallel to the back side; and pouring the material adjacent to the rear face of the panel such that poured material is urged by the deflecting surface on the joist hanger into the through-hole.

The hole-forming step preferably includes forming a chamfer in the lower portion of the through-hole or, more preferably, forming a chamfer in both the lower portion and the upper portion of the through-hole, whereby the creation within the poured material of deleterious voids is further reduced or eliminated. In a preferred method, the hole-forming step conveniently includes cutting a cylindrical bore; and squaring a (preferably lower) circumferential portion of the cylindrical bore.

In accordance with another feature of the invention, where the front face of the panel includes integral furring strips, the securing step preferably includes fastening the joist hanger base to the furring strips as with drywall screws or other suitable fasteners.

In accordance with yet another feature of the invention, where the base of the joist hanger includes a vent extending from the back side of the base to its front side, the method preferably includes monitoring the vent for the presence of material during the pouring step. In this manner, the complete filling of the through-hole with poured material and, hence, the absence of deleterious voids in the poured material, may be conveniently confirmed.

While embodiments of this invention are illustrated and disclosed, these embodiments should not be construed to limit the claims. It is anticipated that various modifications and alternative designs may be made without departing from the scope of this invention.

BRIEF DESCRIPTION OF DRAWINGS

FIG. 5 is a front elevational view of a third exemplary joist hanger for hanging multiple joists in accordance with the invention integrated within a composite wall (again, with a portion of the wall shown in partial cross-section);

FIG. 6 is a front elevational view of the third joist hanger wherein two joists have been repositioned to accommodate an internal wall;

FIG. 7 is a partial sectional view of the third joist hanger and composite wall of FIG. 6 taken along line 7—7 thereof;

BEST MODES FOR CARRYING OUT THE INVENTION

Figure 1:
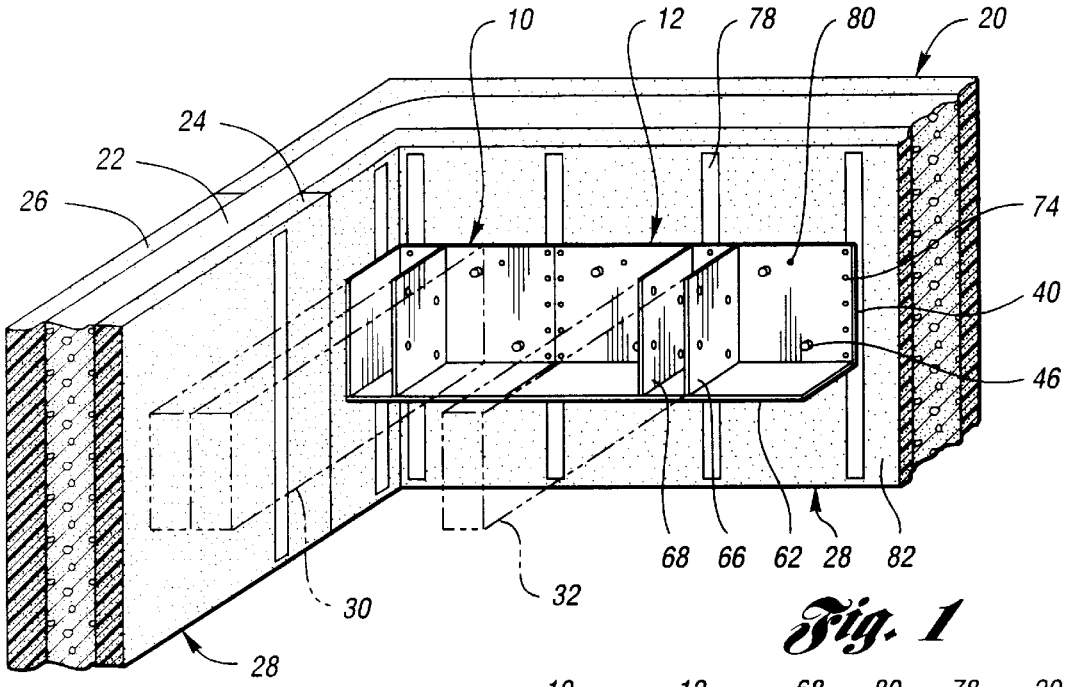
FIG. 1 is a partial perspective view of a first and a second exemplary joist hanger in accordance with the invention integrated within a composite wall formed of concrete poured between a pair of permanent, insulating foam panels.

FIGS. 1–10 show five exemplary joist hangers 10,12,14, 16,18 in accordance with the invention integrated within a composite wall 20 which is itself formed by pouring a suitable curable material 22, such as concrete, between the interior and exterior foam panels 24,26 of a plurality of interlocked modular preforms 28. By way of example only, a suitable modular wall preform 28 for use with the invention is sold by AAB Building Supplies, Inc. of Ottawa, Canada, under the trademark BLUEMAXX®.

Figure 2:
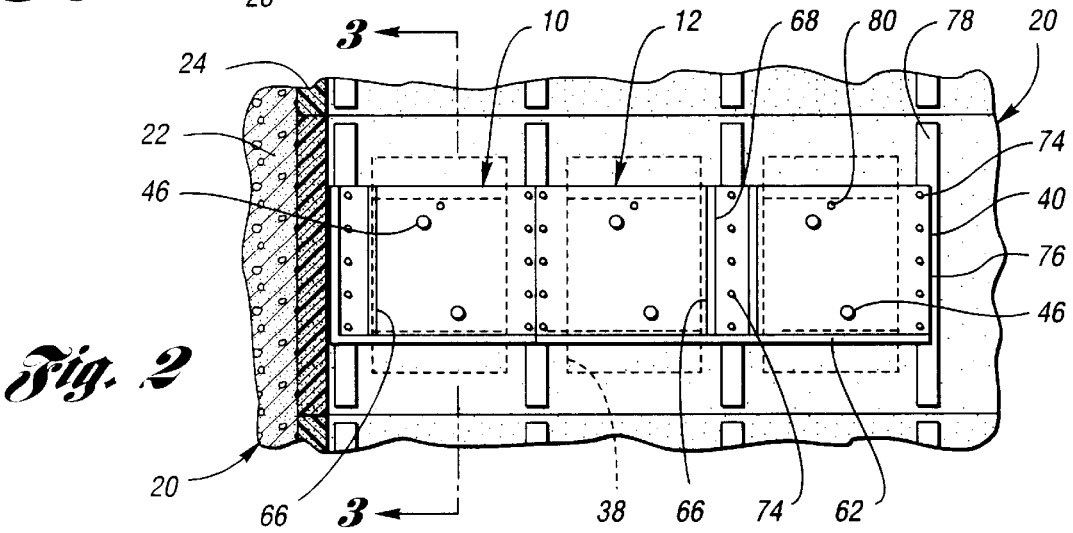
FIG. 2 is a front elevational view of the first and second joist hangers of FIG. 1 (with a portion of the wall shown in partial cross-section), further illustrating, in broken lines, a first configuration for the through-holes formed in the preform's front or "interior" panel.
Figure 8:
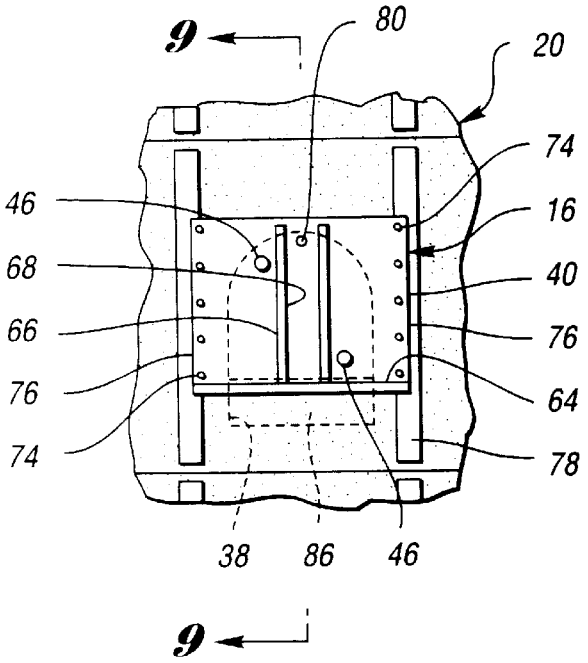
FIG. 8 is a front elevational view of a fourth exemplary joist hanger in accordance with the invention integrated within a composite wall, further illustrating a second configuration for the through-holes formed in the preform's interior panel.
Figure 9:
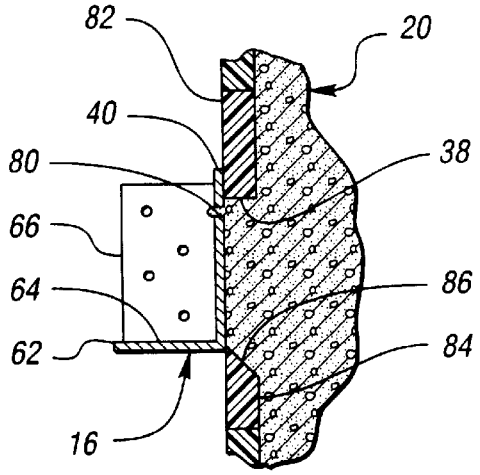
FIG. 9 is a partial sectional view of the fourth joist hanger and composite wall of FIG. 8 taken along line 9—9 thereof.
Figure 10:
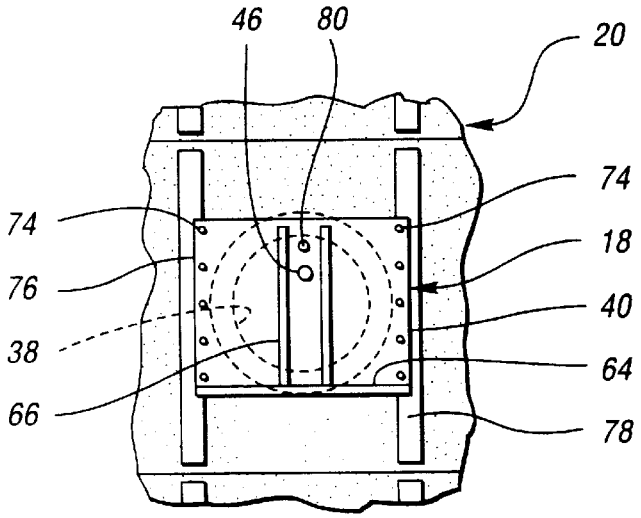
FIG. 10 is a front elevational view of a fifth exemplary joist hanger in accordance with the invention, further illustrating a third configuration for the through-holes formed in the preform's interior panel.

More specifically, FIGS. 1–4 show an adjacent pair of joist hangers 10,12, the first of which is a "left-hand" joist hanger 10 for supporting a single or double rim joist 30, while the second joist hanger 12 supports a single joist 32 along an adjacent span of the wall 20. FIGS. 5–7 show a third joist hanger 14 in accordance with the invention upon which multiple parallel-spaced joists 34 can be hung, and which can conveniently be cut to any desired length. FIGS. 6 and 7 illustrate the ease with which two of the joists 34 can be repositioned on the third joist hanger 14, for example, to facilitate placement of an interior wall 36. FIGS. 8–10 show a fourth and fifth joist hanger 16,18 in accordance with the invention, each of which is meant to support a single joist (not shown) on a given composite wall 20. FIGS. 2, 8 and 10 also respectively illustrate three alternative configurations for the through-holes 38 to be formed in the modular preform's interior panel 24.

Each joist hanger 10,12,14,16,18 includes a thin, flat base 40 having a front side 42 and a back side 44. The back side 44 of the base 40 has a surface area sufficient to cover one or more rearwardly-tapering through-holes 38 formed in the interior panel 24 of one or more of the preforms 28.

Figure 3:
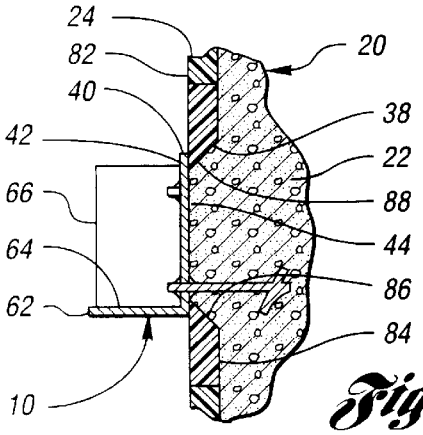
FIG. 3 is a partial sectional view of the first joist hanger and composite wall of FIG. 1 taken along line 3—3 of FIG. 2.
Figure 4:
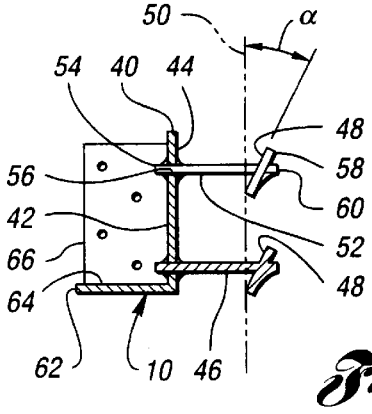
FIG. 4 is a sectional view of the first joist hanger similar to that shown in FIG. 3, prior to integration of the first joist hanger within the wall.

The first, second, third and fourth joist hangers 10,12,14, 16 shown in FIGS. 1–9 each include at least two parallel-spaced anchor members 46 on the back side 44 of the base 40, while the fifth joist hanger 18 shown in FIG. 10 includes but one anchor member 46 on the back side 44 of its base 40. As best seen in FIGS. 3 and 4, each anchor member 46 extends rearwardly from the base 40 to a depth greater the nominal thickness of the interior panel 24 proximate to the through-hole 38 through which it extends. Each anchor member 46 has a deflecting surface 48 defined thereon which is disposed at a first angle a with respect to a reference plane 50 generally parallel to the back side 44 of the joist hanger's base 40.

A preferred range for the first angle a is believed to be between about 5 degrees and about 30 degrees with respect to the reference plane 50. Concrete 22 poured between the preform's panels 24,26 is urged by the angled deflecting surfaces 48 of the anchor members 46 toward the back side 44 of the joist hanger's base 40 and into the through-hole 38. In this manner, the invention ensures that the anchor members 46 are completely encapsulated within the poured concrete 22 along their entire length, thereby reducing or eliminating the likelihood that a deleterious void will be formed within the panel's through-hole 38 when pouring the concrete 22 into the modular wall preform 28.

While the anchor members 46 may be of any suitable configuration and may be joined to the base 40 in any suitable manner, in each illustrated joist hanger 10,12,14, 16,18, the anchor member 46 is an elongate rod 52 whose first end 54 is received in a complimentary bore 56 formed in the joist hanger's base 40 and thereafter welded in place. As seen in FIGS. 3 and 4, the first end 54 of the rod 52 extends through the base 40 to facilitate the welding thereof to both the front and back sides 42,44 of the base 40. In this manner, the first end 52 of each anchor member 46 is nonremovably secured to the base 40, thereby ensuring both that the anchor member 46 extends to the proper depth within the resulting wall 20 and that each anchor member's deflecting surface 48 is properly oriented with respect to vertical when the base 40 is positioned against the panel's interior face 24. The extension of the rod 52 through the base 40 further provides each joist hanger 10,12 with increased load-carrying capacity, in that the load is carried by the bore 56 as well as by the weld.

Similarly, while the invention contemplates use of any suitable anchor members 46 which include the required deflecting surface 48, in each illustrated joist hanger 10,12, 14,16,18, the deflecting surface 48 of each anchor member 46 is conveniently defined by an annular washer 58 welded to the free end 60 of each rod 52.

Each illustrated joist hanger 10,12,14,16,18 includes a first flange 62 on the base 40 extending from its front side 42. The first flange 62, which is preferably integrally formed with the base 40, defines a first joist-supporting surface 64 which is generally perpendicular to the reference plane 50.

Each joist hanger 10,12,14,16,18 further includes a pair of additional flanges 66 extending from the front side 42 of the base 40. The additional flanges 66, which are also secured to the first flange 62, define additional joist-supporting surfaces 68 that are generally perpendicular to the first joist-supporting surface 64 of the first flange 62 The additional flanges 66 provide lateral support for one or more joists 30,32,34 to be supported by the respective joist hangers 10,12,14,16,18 and are preferably secured to both the front side 42 of the base 40 and the first joist-supporting surface 64 of the first flange 62 in any suitable manner, as by welding, to thereby provide greater structural rigidity.

As best seen in FIG. 6, in the event that a joist 34 is preferably relocated, for example, to accommodate placement of an interior wall 70, the joist 34 is readily repositioned as necessary on the supporting surface 64 of the first flange 62 to the left or right of the welded flanges 66. As seen in FIGS. 6 and 7, once the joist has been relocated, a strap 72 of any suitable configuration may be used to provide lateral support for the joist 34, as well as to provide greater strength to the first flange 62.

As best seen in FIGS. 2, 8 and 10, the first, second, fourth and fifth joist hangers 10,12,16,18 each have a plurality of spaced apertures 74 formed in the periphery of the base 40 along each of its vertical edges 76. As best seen in FIGS. 2 and 5, the second and third joist hangers 12,14 also include additional spaced apertures 74 disposed in vertical columns intermediate each hanger's vertical edges 76. The apertures 74 are adapted to receive drywall screws or other suitable fasteners (not shown) with which to secure the base 40 to furring strips 78 integrally formed in the interior panel 24.

As seen in FIGS. 2, 5, 6 and 8–10, in accordance with another feature of the invention, the joist hanger base 40 includes at least one vent 80 formed in the base 40 near an anchor member 46 and extending from the front side 42 to the back side 44 of the base 40 Preferably, the vent 80 is positioned such that, when the base 40 is positioned against and secured to the front face 82 of the interior panel 24, the vent 80 overlies a through-hole 38 into which at least one anchor member 46 extends while also being positioned in a vertical plane above any anchor member 46 extending into that through-hole 38. As seen in FIG. 9, the vent 80 facilitates monitoring the flow of poured concrete 22 into the panel's through-hole 38.

In accordance with the invention, a method for hanging one or more joists on a wall poured between the insulating panels 24,26 of a wall-molding preform 28 using any of the joist hangers 10,12,14,16,18 described above includes forming a through-hole 38 in the interior panel 24 extending from its rear face 84 to its front face 82, and securing the joist hanger 10,12,14,16,18 to the interior panel's front face 82 such the joist hanger's back side 44 covers the through-hole 38 while its anchor members 46 extend into the through-hole 38. With the deflecting surfaces 48 of the joist hanger's anchor members 46 forming an angle $\alpha$ of between about 5 degrees and about 30 degrees with respect to the reference plane 50, the method further includes pouring concrete 22 into the preform adjacent to the interior panel's rear face 84 such that poured concrete 22 is urged by the deflecting surfaces 48 toward the joist hanger's back side 44 and into the interior panel's through-hole 38.

As seen in FIGS. 2, 8 and 10, the hole-forming step preferably includes forming a chamfer in the lower portion 86 of the through-hole 38 or, more preferably, forming a chamfer in both the lower portion 86 and the upper portion 88 of the through-hole 38, whereby the likelihood of creating deleterious voids in the poured concrete 22 is further reduced or eliminated. As seen in FIG. 8, the hole-forming step may conveniently include cutting a cylindrical bore 38 in the interior panel 24 and thereafter squaring the cylindrical bore's lower portion 86. Alternatively, the hole-forming step may provide a rearwardly-tapering through-hole 38 which resembles a conical frustum, as shown in FIG. 10.

In accordance with another feature of the invention, where the front face 82 of the interior panel 24 includes integral furring strips 78, the securing step preferably includes fastening the joist hanger base 40 to the furring strips 78 as with drywall screws or other suitable fasteners.

As described above, in accordance with yet another feature of the invention, where the joist hanger's base 40 includes a vent 80 as described above, the method preferably includes monitoring the vent 80 for the presence of poured material (concrete) during the pouring step. In this manner, the complete filling of the through-hole 38 with poured material 22 may be conveniently confirmed.

While the preferred embodiments of the invention have been disclosed, it should be appreciated that the invention is susceptible of modification without departing from the spirit of the invention or the scope of the subjoined claims. For example, while the anchor members 46 of the first, second, third and fourth joist hangers 10,12,14,16 are illustrated as being both vertically and horizontally offset from one another, it will be appreciated that the invention contemplates use of anchor members 46 which are vertically and/or horizontally aligned with one another.

Similarly, while the anchor members 46 of each disclosed joist hanger 10,12,14,16,18 includes an elongate rod 52 and angled washer 58, the invention contemplates use of anchor members 46 of any suitable configuration, including hooks and loops, which provide an angled deflecting surface 48 with which to urge poured material 22 toward the back side 44 of the joist hanger 10,12,14,16,18, into the panel's through-hole 38 and around each anchor member 46. And, while the anchor members 46 of each illustrated joist hanger 10,12,14,16,18 is nonremovably secured to the base 40 as by welding, the invention contemplates use of anchor members which are nonadjustably secured to the base 40, for example, by fully seating a threaded portion of the anchor member 46 within a complementary threaded bore in the base 40, or by passing a bolt (not shown) through the bore 56 formed in the base 40 and into a complementary threaded coaxial bore (also not shown) formed in the anchor member's first end 54.

What is claimed is:

1. A joist hanger adapted for integration within a wall formed of a poured material, the joist hanger comprising:

a thin base having a front side and a back side;

a first anchor member on the base extending rearwardly from the back side, the first anchor member including a deflecting surface disposed at a first angle with respect to a reference plane generally parallel to the back side, the deflecting surface being adapted to urge poured material toward the back side; and a first flange on the base extending from the front side, the first flange defining a first joist-supporting surface generally perpendicular to the reference plane.

2. The joist hanger of claim 1, wherein the first angle is between about 5 degrees and about 30 degrees.

3. The joist hanger of claim 2, wherein the first anchor member includes a flanged portion, and wherein the deflecting surface is defined on the flanged portion of the first anchor member.

4. The joist hanger of claim 1, wherein an end of the first anchor member is nonremovably secured to the base.

5. The joist hanger of claim 4, wherein the base includes an aperture for receiving the end of the first anchor member, and wherein the end of the first anchor is secured within the aperture.

6. The joist hanger of claim 1, further including:

a second flange on the base extending from the front side, wherein the second flange defines a second joist-supporting surface generally perpendicular to the reference plane;

and wherein an edge of the second flange is secured to the first flange.

7. The joist hanger of claim 6, wherein the first flange is integrally-formed with the base, and wherein the second flange is removably secured to the first flange.

8. The joist hanger of claim 1, including a vent in the base extending between the front side and the back side near the first anchor member.

9. The joist hanger of claim 1, including a second anchor member on the base extending rearwardly from the back side.

10. A joist hanger adapted for integration within a wall formed of an insulating panel and a curable material poured against a rear face of the panel, wherein the panel includes a through-hole extending from the rear face to a front face of the panel, the joist hanger comprising:

a thin base having a front side and a back side;

a first anchor member on the base extending rearwardly from the back side, the first anchor member including a deflecting surface disposed at a first angle with respect to a reference plane generally parallel to the back side, the deflecting surface being adapted to urge curable material toward the back side into the through-hole; and a first flange on the base extending from the front side, the first flange defining a first joist-supporting surface generally perpendicular to the reference plane.

11. The joist hanger of claim 10, wherein the first angle is between about 5 degrees and about 30 degrees.

12. The joist hanger of claim 11, wherein the first anchor member includes a flanged portion, and wherein the deflecting surface is defined on the flanged portion of the first anchor member.

13. The joist hanger of claim 10, wherein an end of the first anchor member is nonremovably secured to the base.

14. The joist hanger of claim 13, wherein the base includes an aperture for receiving the end of the first anchor member, and wherein the end of the first anchor is secured within the aperture.

15. The joist hanger of claim 10, further including:

a second flange on the base extending from the front side, wherein the second flange defines a second joist-supporting surface generally perpendicular to the reference plane; and wherein an edge of the second flange is secured to the first flange.

16. The joist hanger of claim 15, wherein the first flange is integrally-formed with the base, and wherein the second flange is removably secured to the first flange.

17. The joist hanger of claim 10, including at least one additional anchor member on the base extending rearwardly from the back side, and wherein the back side is adapted to cover, at the front face of the panel, each through-hole into which the anchor members are extended.

18. A joist hanger adapted for integration within a wall formed of an insulating panel and a curable material poured against a rear face of the panel, the panel further including a plurality of through-holes extending from the rear face to a front face of the panel, the joist hanger comprising:

a thin base having a front side and a back side;

at least two anchor members on the base extending rearwardly from the back side, a first one of the anchor members including a deflecting surface disposed at a first angle with respect to a reference plane generally parallel to the back side, the deflecting surface being adapted to urge curable material toward the back side into the through-hole; and a first flange on the base extending from the front side, the first flange defining a first joist-supporting surface generally perpendicular to the reference plane.

19. The joist hanger of claim 18, wherein the first angle is between about 5 degrees and about 30 degrees.

20. The joist hanger of claim 19, wherein the first anchor member includes a flanged portion, and wherein the deflecting surface is defined on the flanged portion of the anchor member.

21. The joist hanger of claim 20, wherein the anchor members are nonremovably secured to the base.

22. The joist hanger of claim 18, further including:

a plurality of additional flanges on the base extending from the front side, wherein the additional flanges define a plurality of additional joist-supporting surfaces, each of the additional surfaces being generally perpendicular to the reference plane; and wherein an edge of the second flange is secured to the first flange.

23. The joist hanger of claim 22, wherein the first flange is integrally-formed with the base, and wherein at least one additional flange is removably secured to the first flange.

24. A joist hanger comprising:

a thin base having a front side and a back side;

an anchor member on the base extending rearwardly from the back side, the anchor member including a deflecting surface disposed at a first angle with respect to a reference plane generally parallel to the back side, the deflecting surface being adapted to urge a quantity of a material poured in proximity to the deflecting surface toward the back side; and a first flange on the base extending from the front side, the first flange defining a first joist-supporting surface generally perpendicular to the reference plane, wherein the back side defines a first area having a periphery; and wherein the deflecting surface, when projected in a direction generally normal to the reference plane onto the back side, defines a second area on the back side that is fully encompassed by the periphery of the first area.

25. The joist hanger of claim 24, wherein the first angle is between about 5 degrees and about 30 degrees.

26. The joist hanger of claim 25, wherein the anchor member includes a flanged portion, and wherein the deflecting surface is defined on the flanged portion of the anchor member.

27. The joist hanger of claim 24, wherein an end of the anchor member is nonremovably secured to the base.

28. The joist hanger of claim 27, wherein the base includes an aperture for receiving the end of the anchor member, and wherein the end of the anchor member is secured within the aperture.

29. The joist hanger of claim 24, further including a vent formed in the base within the second area defined thereon.

30. The joist hanger of claim 24, wherein the first flange is integrally-formed with the base, and wherein at least one additional flange is removably secured to the first flange.

31. The joist hanger of claim 24, further including:

a second flange on the base extending from the front side, wherein the second flange defines a second joist-supporting surface generally perpendicular to the reference plane;

and wherein an edge of the second flange is secured to the first flange.

32. The joist hanger of claim 31, wherein the first flange is integrally-formed with the base, and wherein the second flange is removably secured to the first flange.

* * * * *

UNITED STATES PATENT AND TRADEMARK OFFICE

CERTIFICATE OF CORRECTION

PATENT NO : 6,131,358

DATED : October 17, 2000

INVENTOR(S) : Michael A. Wise

It is certified that error appears in the above-identified patent and that said Letters Patent are hereby corrected as shown below:

Col. 10, line 52, claim 31: after "plane;" add --and--

Col. 10, line 53, claim 31, before "wherein" delete "and"

Signed and Sealed this

First Day of May, 2001

*Attest:*

Nicholas P. Godici

NICHOLAS P. GODICI

*Attesting Officer*

*Acting Director of the United States Patent and Trademark Office*